US007824319B2

(12) United States Patent
Carlesimo et al.

(10) Patent No.: US 7,824,319 B2
(45) Date of Patent: Nov. 2, 2010

(54) PUSH-UP SYSTEM

(76) Inventors: Michael O. Carlesimo, 207 Second St., Jackson, NJ (US) 08527; Juan Fernandez, P.O. Box 312, Towaco, NJ (US) 07082; Paul McGrath, P.O. Box 312, Towaco, NJ (US) 07082

( * ) Notice: Subject to any disclaimer, the term of this patent is extended or adjusted under 35 U.S.C. 154(b) by 0 days.

(21) Appl. No.: 12/383,646

(22) Filed: Mar. 27, 2009

(65) Prior Publication Data

US 2009/0247378 A1 Oct. 1, 2009

Related U.S. Application Data

(60) Provisional application No. 61/072,315, filed on Mar. 28, 2008.

(51) Int. Cl.
*A63B 71/00* (2006.01)

(52) U.S. Cl. ..... 482/141; 446/85

(58) Field of Classification Search ..... 482/140–142, 482/148, 91, 907; D21/662, 665, 484; 446/85; 52/612, 596, 561; 404/34; 708/83; 434/303, 434/208, 167; 84/476

See application file for complete search history.

(56) References Cited

U.S. PATENT DOCUMENTS

| | | | | |
|---|---|---|---|---|
| 4,606,732 | A | 8/1986 | Lyman | |
| 5,154,678 | A * | 10/1992 | Adamczyk et al. | 482/52 |
| 5,230,684 | A | 7/1993 | Wallisch | |
| 5,242,355 | A * | 9/1993 | Costa | 482/141 |
| 5,421,800 | A | 6/1995 | Mullen | |
| 5,474,509 | A * | 12/1995 | Hodgdon | 482/52 |
| 5,591,105 | A * | 1/1997 | Dalebout et al. | 482/52 |
| 5,632,707 | A | 5/1997 | Daniel | |
| 5,651,753 | A * | 7/1997 | Wilkinson | 482/52 |
| 5,772,559 | A * | 6/1998 | Sithole | 482/52 |
| 6,402,664 | B1 * | 6/2002 | Marston | 482/52 |
| 6,471,623 | B1 | 10/2002 | Lin | |
| 7,108,643 | B2 | 9/2006 | Wilson | |
| 7,144,351 | B2 * | 12/2006 | Kastelic | 482/52 |
| 7,156,791 | B2 | 1/2007 | Edwards | |
| 7,318,794 | B2 | 1/2008 | Davies | |

(Continued)

FOREIGN PATENT DOCUMENTS

KR 20-1982-0002416 Y1 11/1982

(Continued)

OTHER PUBLICATIONS

PCT Int'l Search Report, Oct. 13, 2009, Carlesimo, Michael et al.

(Continued)

*Primary Examiner*—Lori Baker
(74) *Attorney, Agent, or Firm*—Gearhart Law, LLC.

(57) ABSTRACT

The disclosure described by this invention describes a system for performing a variety of push-up exercises is disclosed. The present invention comprises multiple blocks that are arranged into columns. The user can adjust the height and width of the columns to accommodate body size, as well as the type of exercise being performed. This adds a new dimension to the basic push-up, allowing the user to perform a variety of different types of push-up. The system helps to strengthen and stretch the human body, and achieve optimum performance by working different areas of the body, promoting peak development of the musculoskeletal system.

29 Claims, 7 Drawing Sheets

U.S. PATENT DOCUMENTS

| | | | |
|---|---|---|---|
| 7,468,025 | B2 | 12/2008 | Hauser |
| 2006/0089241 | A1 | 4/2006 | Klein |
| 2007/0161476 | A1 | 7/2007 | Davies |
| 2007/0219076 | A1 | 9/2007 | Axelrod |

FOREIGN PATENT DOCUMENTS

| | | | |
|---|---|---|---|
| KR | 20-1992-0003999 | Y1 | 6/1992 |
| WO | WO 99/43574 | | 9/1999 |

OTHER PUBLICATIONS

PCT Written Opinion, Oct. 13, 2009, Carlesimo, Michael et al.

* cited by examiner

PUSH-UP SYSTEM

CLAIM OF PRIORITY

This application claims the priority of U.S. Ser. No. 61/072,315 filed on Mar. 28, 2008, which is incorporated herein by reference.

FIELD OF THE INVENTION

This invention generally relates to exercise equipment. More specifically, this invention relates to exercise equipment used for performing a variety of push-up exercises.

BACKGROUND

Push-ups are a well known, widely accepted exercise for developing upper body strength. The push-up develops strength in the chest, as well as triceps and shoulders. Another advantage of push-ups is the convenience of which they can be performed. They can typically be performed at home, or anywhere with sufficient floor space. While the basic push-up is a good exercise in developing physical fitness, by varying the form of the push-up, the upper body muscles can be stressed in different ways to further enhance the effectiveness of the workout. Therefore, it is desirable to have a system for performing a variety of different types of push-ups.

U.S. Pat. No. 5,230,684 teaches a portable, lightweight and hand-held triceps muscle exerciser that has a base with a flat lower surface and a pair of arms extending upwardly therefrom and joined together to form a structure having an isosceles triangle shape. Grips are provided on each arm intermediate their ends. The arms extend from the base at an angle of about 35 degrees.

U.S. Pat. No. 7,108,643 teaches an elongate floor-supported platform having sliding handgrips mounted thereon. In a preferred embodiment, the handgrips, which are constrained to move only along a track, which may be linear or curvilinear and lying in a substantially horizontal plane, are interconnected by linking means such as belts. The linkage is such that the handgrips remain equidistant from a fixed centerline midway between the handgrips throughout their range of motion. In the preferred embodiment, the linking means are belts that are supported by pulleys housed within the floor-supported platform. In yet a further embodiment, the platform includes wall and/or ceiling attachment means and can be employed for performing pull-ups.

U.S. Pat. No. 7,144,351 teaches an exercise device comprising three blocks: a "first block", a "second block" and a "third block". Each block has a horizontal platform (herein, "first horizontal platform", a "second horizontal platform" and a "third horizontal platform") upon which the user can stand on and perform all types of exercise activity. It is preferred that three blocks are connected together by two hinges (herein, a "first hinge" and a "second hinge"). It is also preferred that the three block be of graduating heights. It is preferred that the first hinge be connected between the first block and a first vertical corner of the second block so that the first hinge rotates about an first axis that that is perpendicular to the plane formed by the first horizontal platform. It is also preferred that the second hinge be connected between the third block and the second vertical corner of the second block so that the second hinge rotates about a second axis that is perpendicular to the plane formed by the second horizontal platform. In the preferred embodiment, the first vertical corner of the second block is diagonally opposite from the second vertical corner of the second block.

U.S. Pat. No. 5,421,800 teaches a portable device that assists exercisers who do pushups or use free weights through the difficult portion of the exercise motion, so as to allow exercisers to obtain better results more efficiently: Upper and lower surfaces, a force-generating device and a force-transferring device cooperate to transfer a selected amount of upward force to an exerciser's body (in the case of pushups) or a barbell (in the case of free-weight exercise) through a predetermined portion of the exercise motion. Thus, this device allows an exerciser to combine the benefits of variable-resistance exercise machines with the benefits of pushups and free-weight exercise. Also, exercisers not strong enough to do pushups will be able to do them with this device, other exercisers will be able to obtain better results doing pushups, and all exercisers will be able to perform back exercises with the same device, and then fold up the device into a compact briefcase size and shape for travel or storage.

U.S. Pat. No. 5,632,707 teaches a device for exercising a user's upper torso that utilizes a minimum of space. A wheeled housing is provided with a handle member providing an effective grip to a user who will lean his or her body's weight against the device is coupled to one or more of the wheels to display the amount of rotation of the wheels thereby giving an indication to a user of the amount of exercise undertaken. A reader of the movement of the device has an output connected to a counter/display that is resettable. The reader is mounted in a spring loaded cavity so that an effective outwardly force brings its ball member in contact with the surface.

U.S. Pat. No. 7,156,791 teaches yoga grip blocks having one or more block sections and a grip section that provide support and comfort in the practice of yoga exercises. The invention includes preferred materials to fabricate yoga grip blocks and describes methods of using yoga grip blocks.

U.S. Pat. No. 6,471,623 teaches a push-up exercise holder. The holder includes a seat, a lever that is pivotally installed on the holder, and an elastic buffer element is installed between the seat and the lever. A holding portion of the lever is elevated and positioned on the seat, and a notch is formed between the lever and seat so that as the push-up exercise holder is held, it generates a buffer effect with upward and downward movement of a body.

U.S. Pat. No. 7,318,794 teaches a yoga block system which includes a first block and a second block which can either be rectangularly shaped or triangularly shaped. These blocks are capable of joining with one another, releaseably, along either a common face when the blocks are rectangular or along the hypotenuses when the blocks are triangularly shaped. At least one of these blocks is preferably hollow enabling a user to gain access to its interior. Notwithstanding the elements used to join them, each block presents to a user faces which remain substantially planar.

U.S. Pat. No. 7,468,025 teaches a push-up exercise unit and device is described which may enable a user to move with his/her body's natural rotation to engage additional muscle groups with reduced stress on joints. The device can include a handle support structure having a pair of columns between a lower base and a separate end cap such that the handle intersects a corresponding end cap and upper portion of a corresponding column of the handle support structure. The device includes a fixed base support attached to the handle support structure, and a bearing assembly to permit rotation of the contiguous handle, end caps and handle support structure by a user with the base support resting on a planar surface. In another example, the handle assembly is detachable from a first surface on the handle support structure and inserted into a second surface to facilitate stowage for travel.

US Publication 20060089241 teaches a pushup wedge. The pushup wedge is made of an elastomeric material with a density in the range of about 25 kg/m.sup.2 to about 150 kg/m.sup.2 and has a generally wedge shape with a sloping top that slopes between about 5 and 20 degrees from the horizontal from a lower front portion to a higher rear portion, wherein the rear portion has a generally curved contour. A retention strap can be further included that passes over sloping top, which retention strap is adapted for retaining a user's hand between the strap and the sloping top.

US Publication 20070161476 teaches a yoga block system which includes a first block and a second block which can either be rectangularly shaped or triangularly shaped. These blocks are capable of joining with one another, releaseably, along either a common face when the blocks are rectangular or along the hypotenuses when the blocks are triangularly shaped. At least one of these blocks is preferably hollow enabling a user to gain access to its interior. Notwithstanding the adjoining means, each block presents to a user faces which remain substantially planar.

US Publication 20070219076 teaches a yoga block that is in two identical sections which disassemble to form two yoga wedges. The two yoga wedges are held together in block form by a cylinder passing through both wedges when the wedges are aligned into the yoga block form.

Although the prior art discloses aids for executing push-ups, none of the patents or publications cited above disclose the present invention. The present invention allows the user to stack interlocking or frictionally engaging blocks or foam pads to achieve a maximum work out. The blocks/pads are stand-alone, and may be stacked to different heights for each side of the body, allowing a weaker arm to be worked less than the stronger arm during a push up. The push up blocks/pads can be used in a number of ways for exercising a number of different muscle groups. One use that provides a major advantage over the prior art is for 'reverse pushups', in which the user sits with his back to the blocks, his hands on the blocks, and pushes up to work a range of muscle groups that are not worked by conventional push-ups.

SUMMARY OF THE INVENTION

The present invention is an article of manufacture comprising a stack of blocks, the stack having at least a top block and a bottom block, the top block having an interlocking mechanism which removably connects the top block to the bottom block and maintains the position of the top block relative to the bottom block and wherein the top block has a top surface, and the top surface is substantially uniform.

The present invention comprises a plurality of blocks that are arranged into columns. The user can adjust the height and width of the columns to accommodate body size, as well as the type of exercise being performed. The present invention adds a new dimension to the basic push-up, allowing the user to perform a variety of different types of push-up. The present invention helps to strengthen and stretch the human body, and achieve optimum performance by working different areas of the body, and promoting peak development of the musculoskeletal system.

It is an object of the invention to provide a device for use in exercise.

It is an object of the invention to provide a device to facilitate the performance of push-ups.

It is an object of the invention to provide a plurality of blocks for stacking to a user's preferred height for performing push-ups or other exercise.

It is an object of the invention to provide a plurality of blocks for stacking for performing push-ups.

It is an object of the invention to provide a plurality of stacking blocks for performing reverse push-ups.

It is an object of the device to provide an exercise mat to aid in exercises with the stacking blocks.

DETAILED DESCRIPTION

Figure 2:
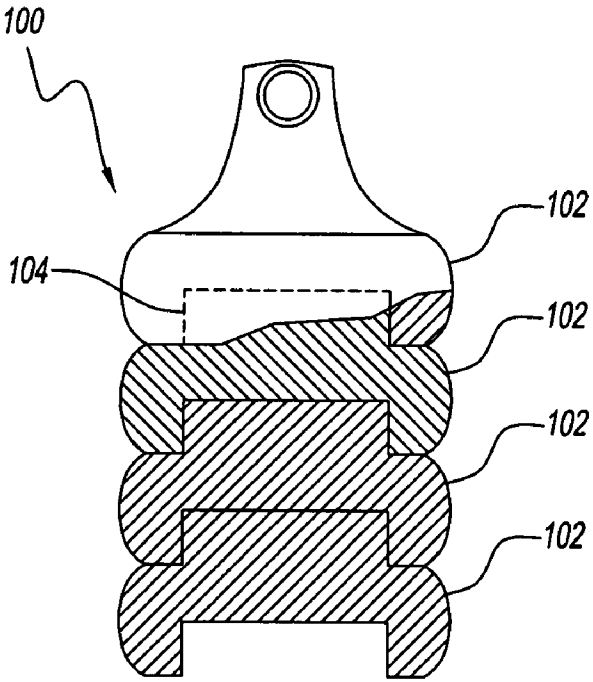
FIG. 2 is a front cut away view illustrating rectangular interlocks and a handle.
Figure 1:
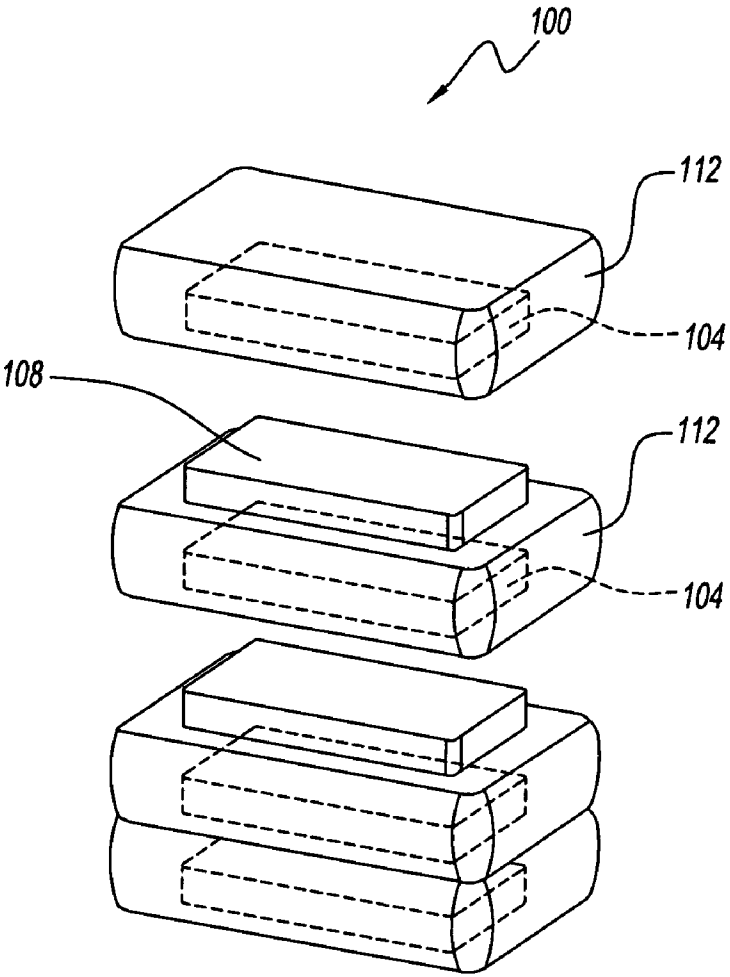
FIG. 1 is an exploded perspective view of an embodiment of the present invention, showing individual blocks having rectangular interlocks.

FIG. 1 and FIG. 2 show an embodiment of the present invention, showing individual blocks having rectangular interlocks. A column 100 is formed by arranging a plurality of blocks into a stack. The blocks are comprised of two types: Top block 112, and lower block 102. A lower block 102 may serve as the bottom block, or an intermediate (middle) block within column (for the purposes of this disclosure, a column may also be referred to as a "stack") 100. A middle block is a block that has a block below it and a block above it. A bottom block rests on the ground (floor) surface. Each lower block has a protrusion 108, and a cavity (for the purposes of this disclosure, a cavity may also be referred to as a "hollow") 104. The cavity 104 is configured to removably receive the protrusion 108 from the neighboring block immediately below it, thereby comprising an interlock mechanism. The top block 112 has cavity 104, but does not have a protrusion, thereby providing a larger surface area for the user to contact with during use. The top surface area of top block 112 is substantially uniform (flat). However, top block 112 may optionally comprise a gripping surface on its top, such as but not limited to, a knurled pattern, foam pad, leather or vinyl, which may be attached or molded (not shown) to increase the friction between the user and the top block 112. This serves to prevent slipping during use of the invention.

Top block 112 may also have handles or rotating handles. In addition, the blocks may have a flat, rectangularly shaped rotating piece, i.e, a turntable. Rotation may be effected by any means, but may, for example be done utilizing a "Lazy Susan" type device, where the bottom portion of Lazy Susan is attached on the top surface of the top block 112 and a rotating block or handle is attached to the top part of the Lazy Susan. In other embodiments the rotation can be effected by a ball and socket system or a ball mounted on a post system. A spring may be used so that the rotation device returns to the at rest position. The rotation mechanism could also include a locking feature that locks the rotating handles in on or more positions. One suitable rotation system is taught in U.S. Pat. No. 7,468,025 issued on Dec. 23, 2008, which is incorporated herein by reference.

The handles which could be removably or permanently attached to the top block 112 or a turntable or to a middle or lower block 102. When the handle is attached to the middle or lower block 102, the top block cavity 104 may be sized and configured to receive the handle either attached or when removed. The turntable may also be removably affixed to top block 112 or middle or lower block 102, and stored with the one or more blocks or with the cavities between the blocks.

The handles can u-shaped, having single or multi-piece construction (as in U.S. Pat. No. 7,468,025), have only a single support or may be a single tube recessed with in the top block 112 or middle or lower block 102.

Top block 112 may also have a removable top portion that can be flipped and replaced, back into the top block 112, to give the top block 112 different contours, such as concave to convex, or flat to convex, etc., or different textured gripping surfaces. The top block 112 may be further designed to receive a platform that the user can stand on. This platform can be rectangularly shaped with moving slides that allow the user to slide his feet back and forth. The block or platform may have retractable supports that keep the block stack from tipping.

The blocks are preferably formed of a sturdy molded plastic, capable of supporting at least 150 pounds, and more preferably, at least 200 pounds. The blocks may be manufactured from a variety of materials, including but not limited to, plastics, rubbers, elastomers, foams, wood, fiberglass, metals, fabrics, or any combination of these materials, and different materials may be used in different parts of the blocks, for instance, a foam rubber may be used in the interior of the block while a vinyl or neoprene covering is used as the exterior. While the walls of the blocks are shown as convex, the walls may be straight or concave. The walls may also have indentations that allow the user to easily grip the blocks for separating same from each other.

The size of the blocks can vary, having a width between 1 inch and 36 inches, with a preferred width between 5 and 6 inches, and having a length between 1 inch and 72 inches, with a preferred length between 8 and 9 inches. The wall height of each block may vary between from ¼ inch to 48 inches, with an exemplary embodiment ranging from 1 inch to 3 inches. The columns may be stacked to any height, from ¼ inch to 48 inches, with a typical, column configured to have a height of between 3 and 14 inches, more preferably, 6 and 14 inches.

Figure 3:
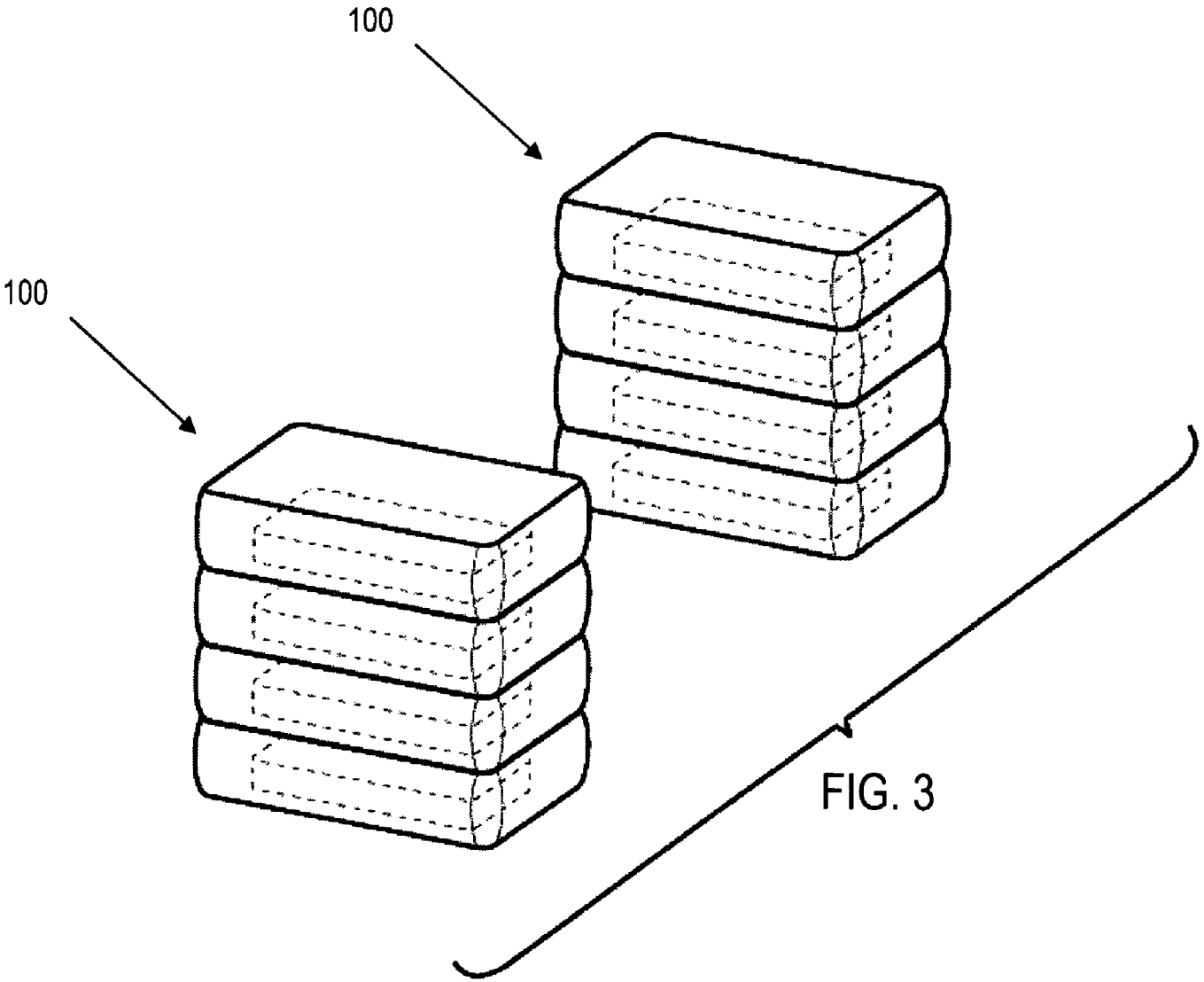
FIG. 3 is a top perspective view of the present invention showing two columns.
Figure 5:
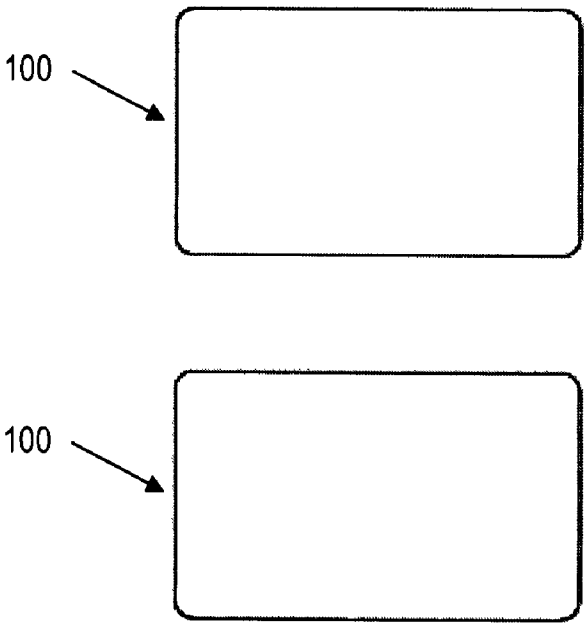
FIG. 5 is a top view of the present invention showing two columns.
Figure 4:
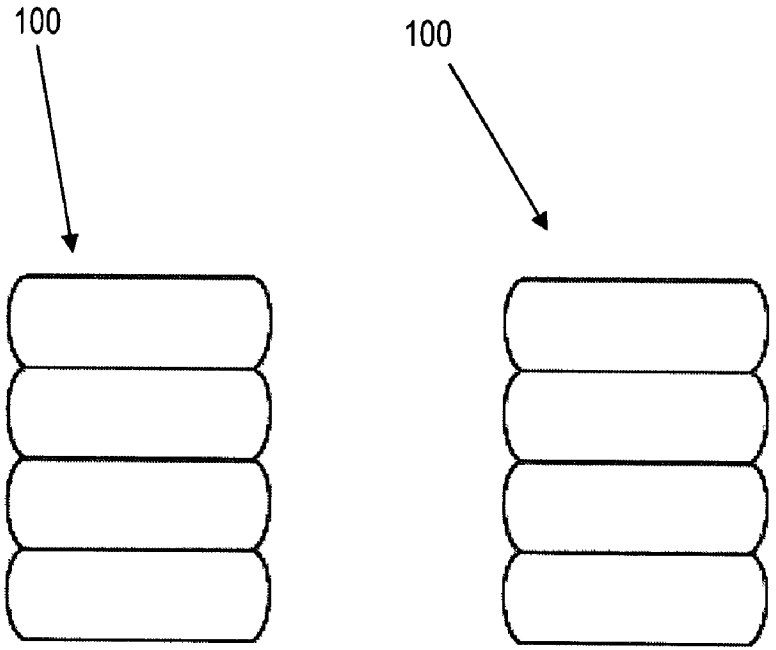
FIG. 4 is a front view of the present invention showing two columns.

FIGS. 3, 4 and 5 show an exemplary configuration of the present invention for performing exercises. In this configuration, two columns 100 are placed at a desired distance for performing push-up exercises. FIG. 4 shows a front view of the configuration of FIG. 3, and FIG. 5 shows a top view of the configuration of FIG. 3. Although the column heights are shown as being the same in these figures, the two columns may be of differing heights, for instance, the right hand column may be comprised of 4 blocks while the left hand column is comprised of two blocks, or any number and configuration of blocks that is desired by the user.

Figure 6:
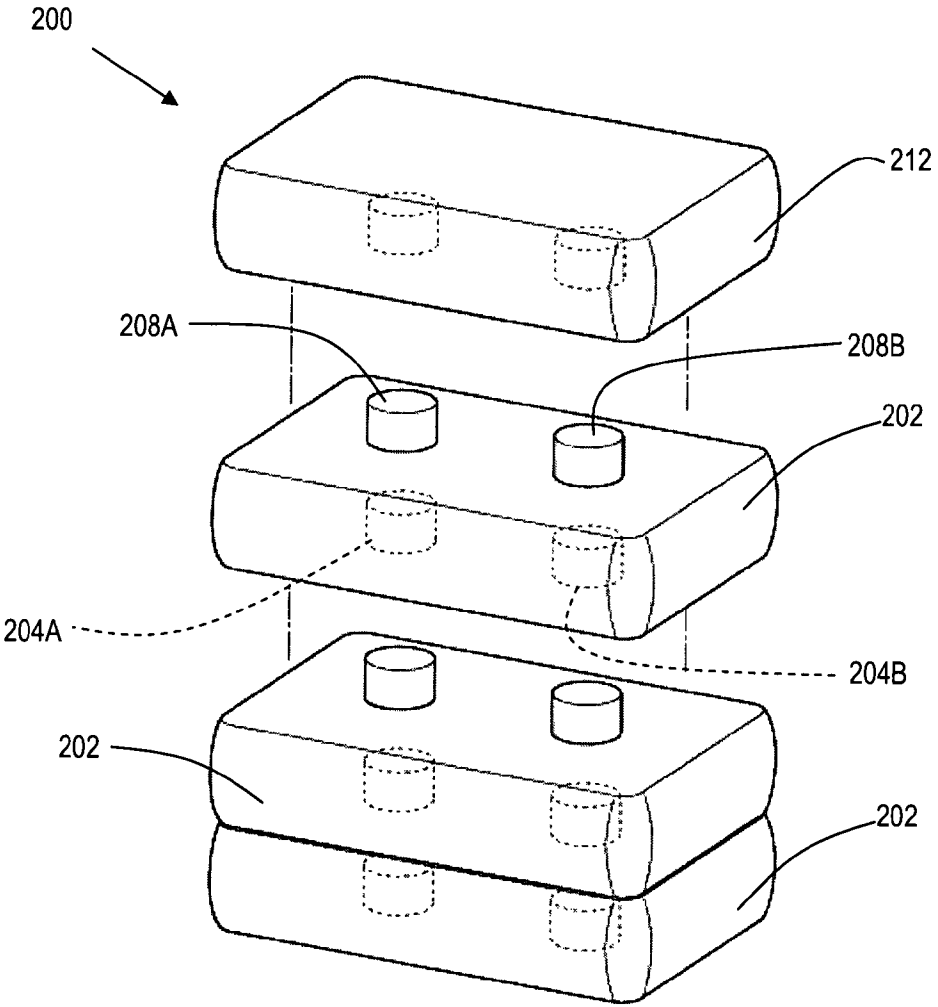
FIG. 6 is an exploded perspective view of an alternative embodiment of the present invention.

FIG. 6 shows an alternative embodiment of the present invention. In this embodiment, a column 200 is formed from a plurality of lower blocks 202, and a top block 212. The lower blocks 202 have two cavities 204A and 204B, and two cylindrical protrusions 208A and 208B. The cavities 204A and 204B of each block are configured to receive the protrusions 208A and 208B from the neighboring block immediately below it, thereby comprising an interlock mechanism. The top block 212 has cavities 204A and 204B, but does not have any protrusions, thereby providing a larger surface area for the user to contact with during use.

Figure 7:
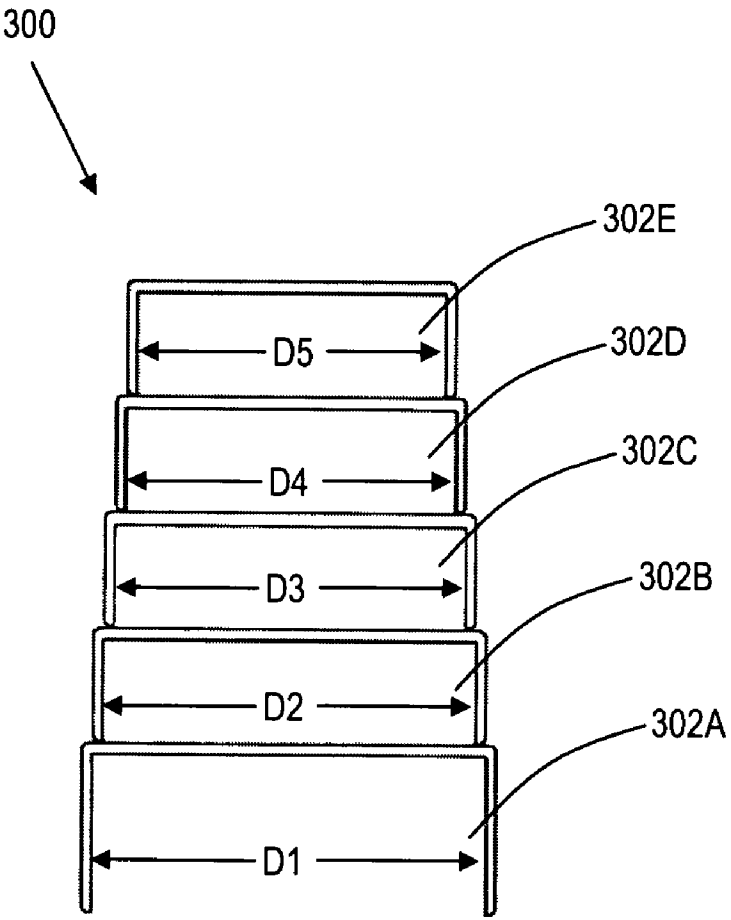
FIG. 7 is a front view of another alternative embodiment of the present invention.

FIG. 7 shows yet another alternative embodiment of the present invention. In this embodiment, each block is of a varying size. In this embodiment, five blocks (302A-302E) are shown, where block 302A is the lowest block, and 302E is the top block. Each block has a corresponding width, wherein block 302A has width D1, block 302B has width D2, block 302C has width D3, block 302D has width D4, and block 302E has width D5. The widths (D1-D5) are chosen such that D1>D2>D3>D4>D5, thereby forming a stable column 300, when arranged in a sequence (from bottom to top) of 302A, 302B, 302C, 302D, and 302E, as illustrated in FIG. 7. Note that to configure column 300 with a lower height, some of the blocks (for example, blocks 302B and 302C) may be omitted from column 300.

Figure 8:
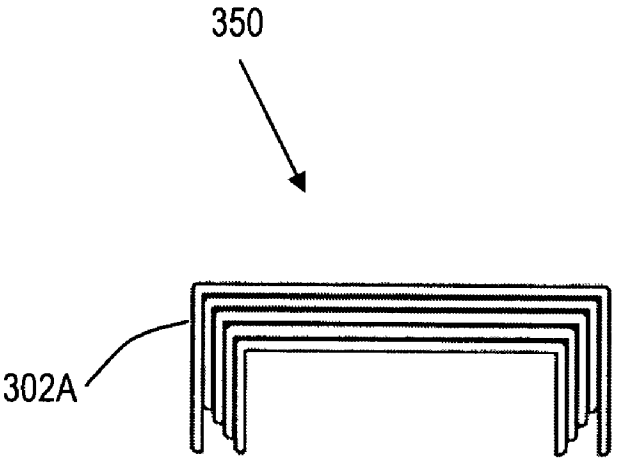
FIG. 8 is a view of the embodiment of FIG. 7, in a stowed configuration.

FIG. 8 shows the embodiment of FIG. 7 in a stowed configuration. The various blocks are stowed within the lowest block 302A. This facilitates easy storage and portability. For example, with the embodiment of FIG. 8, the present invention may easily fit within a standard travel suitcase, allowing a user to use the present invention while traveling.

As an alternative, the blocks could be formed in a certain shape so that they stack in a reduced height but when rotated 90 or 180 degrees the blocks would be at the full height. This could be done with a design that incorporates indents and bump outs that permit the nesting and stacking.

While in FIGS. 1-8 three different methods for stacking the blocks are illustrated, other stacking methods may be used. For instance, including but not limited to, the blocks may be clamped together, snapped together, joined by hook and eye fasteners, they may have friction inducing surface material that allows them to stay together through frictional forces, they may be joined by adhesives that are releasable, they may be strapped together, or they may permanently adhered together if desired, Although the blocks disclosed in FIGS. 1-8 are illustrated as rectangular, any of the blocks discussed herein may be any shape, including but not limited to, shapes that allow for finger grips, geometric shapes including but not limited to squares, circles, triangles, stars, polygons, oblong, animal or cartoon character shapes, plant shapes, automobile or train shapes, household item shapes, such as but not limited to, TV shapes, furniture shapes and their 3-dimensional bodies. The blocks may be any color and may have imprinted images, designs or lettering on them, including but not limited to, computer generated images, stencils, digital images, names, advertising, or logos.

A specially shaped accessory that attaches to a block could be incorporated for the purpose of holding ones foot or leg. This attachment would be to assist in stretching type movements such as Pilates, simple stretches, or exercises like sit-ups. The special shape would be used as an assistant to the user as if an extra person was assisting in holding their legs.

Blocks could be designed so that on or more blocks or block stacks could interlock and/or be grouped together. Special shapes, handles, post, magnets could be used. This would assist in transporting the blocks or combining them together to make a larger platform, for example to make a stepper platform. The block stacks could be held together with resistance bands that could also be used for additional exercises.

Rollers, wheels or sliding panels could be added to the lower block 104, or possibly as an attachment or part of the main product and one of the blocks. This would permit the movement of the blocks so that abdominal or stretching exercises could be done. A single or multiple wheel or rollers can be partially contained within a specially configured lower block 104. The user can do additional abdominal exercises by kneeling and stretching out while holding the blocks and leaning forward. An optional spring or resistance mechanism attached to the wheel can help propel the blocks back toward the user.

Figure 9:
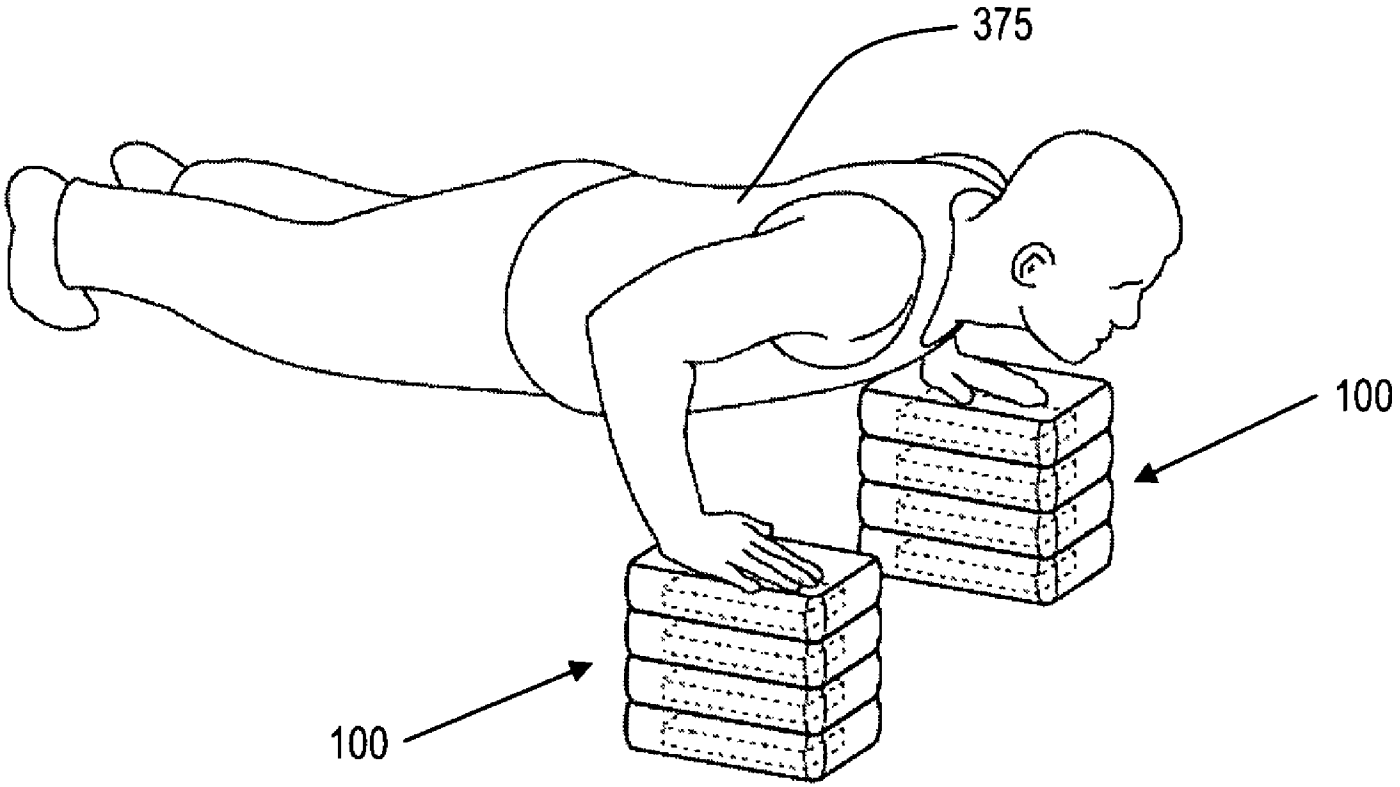
FIG. 9 illustrates a use of the present invention.

FIG. 9 shows a user 375 performing a standard push-up with the present invention, using two columns 100. By utilizing the present invention, a longer range of motion is possible, allowing for increased stretch and muscular development.

Figure 10:
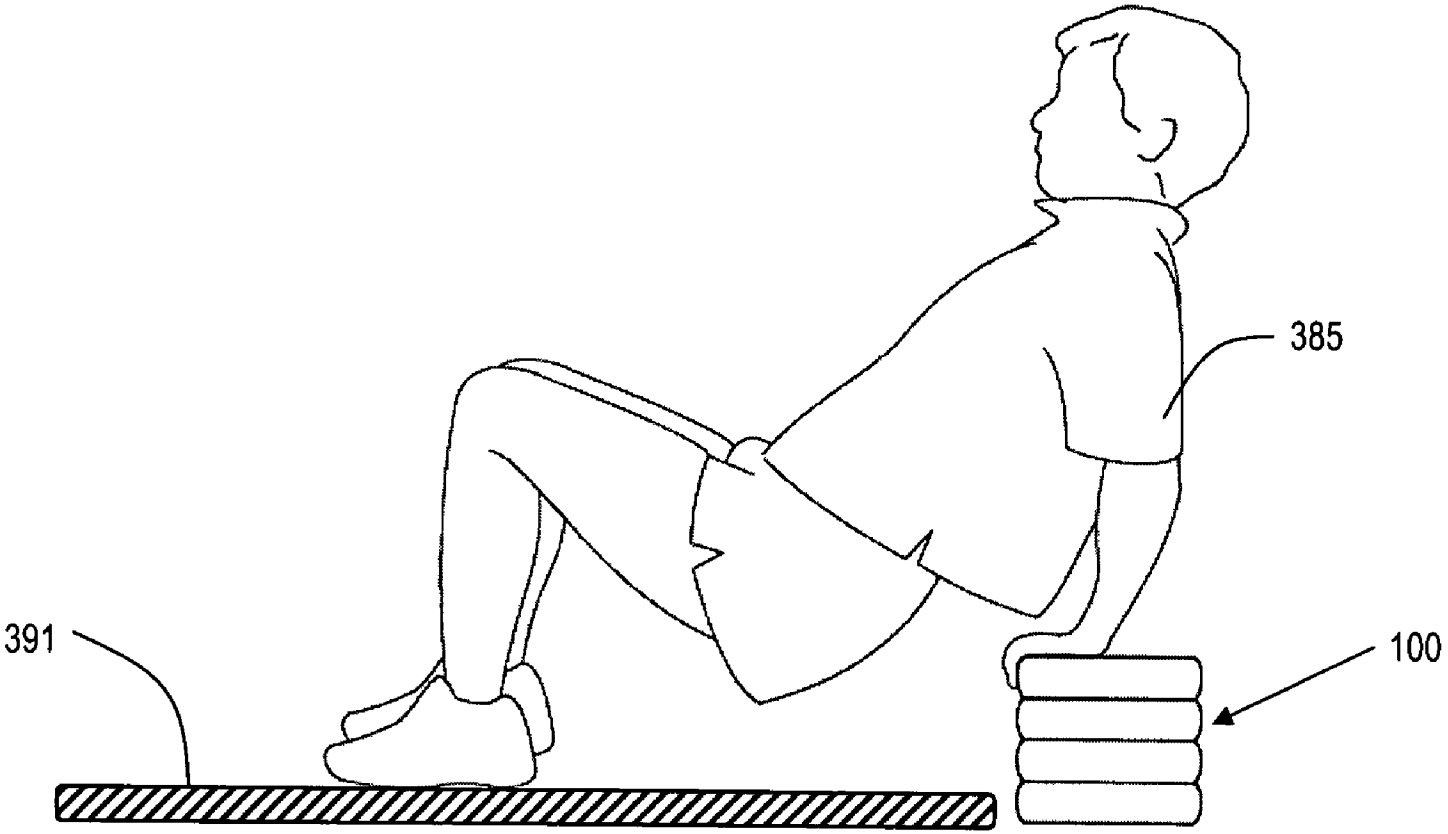
FIG. 10 illustrates an alternative use of the present invention.

FIG. 10 shows another user 385 performing a reverse push-up or "dip" using the present invention, again utilizing two columns 100 (note only one column 100 is visible in the side view of FIG. 10). FIG. 10 also illustrates the optional use of exercise mat 391, to provide improved comfort during use. Exercise mat 391 may also have exercise instructions on it, and indications where to put the user's hands and/or feet, knees or elbows when using the exercise mat 391 with columns 100. The instructions may give different exercises, varying the number of blocks used, the placement of the blocks, and the placement of the user's body parts, including any part of the human body. The indications of where to put the user's body parts may be written instructions or there may be imprinted pictures of body parts or their outlines in the areas of the mat where the user's body parts belong for a certain exercise. There may be one set of exercise instructions and/or images, or there may be many, possibly color-coded to indicate which instructions and images belong together. Coding other than color may be used, including but not limited to, type of font used, shading, boldness or lightness of print, the texture of the fabric of the mat cover, or any other means that conveys the desired information.

Although the invention is intended for the user to preferentially use two columns 100 of blocks, one for each hand, the invention may also be used with only one column 100 of blocks for both hands, or the user may use only one column 100 with one hand and no blocks or pads for the other hand.

Note that while two uses of the present invention are illustrated (FIG. 9 and FIG. 10), there are many possible variations. Including, but not limited to, the following alternate uses. In one alternate use, the user performs push-ups with knees on ground surface, and hands on columns. In another alternate use, the user performs push-ups with knees on ground surface, and forearms on columns. In another alternate use, the user performs push-ups with feet on ground surface, and forearms on columns.

It is also possible to have the two columns configured to unequal heights (e.g., a lower column and a higher column). This is used in exercises to isolate a single arm (i.e. a "one-arm" push-up). In this usage, the arm supported by the lower column is doing more work than the arm supported by the higher column.

The reader will recognize that many other possible exercise variations are possible with the present invention. Furthermore, while the description above contains many specific details, these should not be construed as limiting the scope of the invention, but merely as providing illustrations of some of the presently preferred embodiments of the present invention.

What is claimed is:

1. An article of manufacture, a push up system, comprising: a stack of rectangular shaped push up blocks configured for arrangement in columns; the stack having at least a top block and a bottom block; the top block having an interlock mechanism which removably connects the top block to the bottom block and maintains the position of the top block relative to the bottom block, and the top block further comprises a handle configured for rotational movement; and at least one middle block, wherein the middle block has a top interlock mechanism that connects the top block to the middle block and maintains the middle block's position relative to the top block, and a bottom interlock mechanism that connects the middle block to the bottom block and maintains the middle block's position relative to the bottom block.

2. The article of claim 1, further comprising a plurality of middle blocks, wherein each middle block has an interlock mechanism which can connect the middle block with a top block, a middle block or a bottom block, and further wherein each interlock mechanism maintains each middle block's position relative to a top block, another middle block or a bottom block.

3. The article of claim 2, wherein each top block and middle block has a bottom surface and at least one hollow in each said bottom surface, and each bottom and middle block has a top surface, and each said top surface has at least one protrusion sized to removably fit within the hollow of a corresponding block, thereby providing an interlock mechanism which can maintain the position of a top block, middle block or bottom block relative to another block connected thereto.

4. The article of claim 3, wherein the hollow and the protrusion are rectangular.

5. The article of claim 3, wherein there are at least two hollows and two protrusions per block and the hollows and the protrusions are cylindrical.

6. The article of claim 1, wherein the blocks are rectangularly shaped, and have a width between 5 and 6 inches, and a length of between 8 and 9 inches.

7. The article of claim 6, wherein the blocks have a wall height and the wall height is between 1 and 3 inches.

8. The article of claim 1, wherein the uniform top surface is a gripping surface.

9. The article of claim 1, wherein the stack of blocks is between 2 and 14inches in height.

10. The article of claim 1, wherein the blocks are made of a material that does not substantially deform when a weight of at least 150 pounds is disposed thereon.

11. The article of claim 1, wherein the top block further comprises a handle.

12. The article of claim 1, wherein the top block further comprises a rotating handle.

13. The article of claim 1, wherein the top block further comprises a rotating rectangular section.

14. An article of manufacture, comprising: at least two stacks of rectangularly shaped push up blocks arranged in separately spaced parallel columns; each stack having at least a top block and a bottom block; and each top block having an interlock mechanism which removably connects the top block to the bottom block and maintains the position of the top block relative to the bottom block; and wherein each top block has a top surface, and the top surface is substantially uniform and; at least one middle block, wherein the middle block has a top interlock mechanism that connects the top block to the middle block and maintains the middle block's position relative to the top block, and a bottom interlock mechanism that connects the middle block to the bottom block and maintains the middle block's position relative to the bottom block; the top block further comprises a handle configured for rotational movement.

15. The article of claim 14, wherein each stack further comprises a plurality of middle blocks, wherein each middle block has an interlock mechanism which can connect the middle block with a top block, a middle block or a bottom block, and maintain each middle block's position relative to a top block, another middle block or a bottom block.

16. The article of claim 15, wherein each top block and middle block has a bottom surface and at least one hollow in each said bottom surface, and each bottom and middle block has a top surface, and each said top surface has at least one protrusion sized to removably fit within the hollow of a corresponding block, thereby providing an interlock mechanism which can maintain the position of a top block, middle block or bottom block relative to another block connected thereto.

17. The article of claim 16, wherein the hollow and the protrusion are rectangular.

18. The article of claim 16, wherein there are at least two hollows and two protrusions per block and the hollows and the protrusions are cylindrical.

19. The article of claim 14, wherein the blocks are rectangularly shaped, and have a width between 5 and 6 inches, and a length of between 8 and 9 inches.

20. The article of claim 19, wherein the blocks have a wall height and the wall height is between 1 and 3 inches.

21. The article of claim 14, wherein the uniform top surface is a gripping surface.

22. The article of claim 14, wherein each stack of blocks has a height of between 2 and 14 inches.

23. The article of claim 14, wherein the blocks are made of a material that does not substantially deform when a weight of at least 200 pounds is disposed thereon.

24. The article of claim 14, further comprising an exercise mat.

25. The article of claim 14, wherein the top block further comprises a handle.

26. The article of claim 14, wherein the top block further comprises a rotating handle.

27. The article of claim 14, wherein the top block further comprises a rotating rectangular section.

28. The article of claim 14, wherein the stacks may be joined together.

29. The article of claim 14, wherein the bottom block has a wheel or roller mechanism.

* * * * *